US007481419B2

(12) United States Patent
Kim

(10) Patent No.: US 7,481,419 B2
(45) Date of Patent: Jan. 27, 2009

(54) TWO-WAY PAPER PICKUP SYSTEM

(75) Inventor: Soo-hyun Kim, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 324 days.

(21) Appl. No.: 11/030,180

(22) Filed: Jan. 7, 2005

(65) Prior Publication Data

US 2005/0189695 A1 Sep. 1, 2005

(30) Foreign Application Priority Data

Jan. 27, 2004 (KR) ..... 10-2004-0004979

(51) Int. Cl.
*B65H 3/44* (2006.01)

(52) U.S. Cl. ..... 271/9.01; 271/117; 271/162

(58) Field of Classification Search ..... 271/117, 271/162, 164, 9.01; 399/393; 347/104
See application file for complete search history.

(56) References Cited

U.S. PATENT DOCUMENTS 3,306,491 A * 2/1967 Eisner et al. ..... 221/41
4,925,062 A * 5/1990 Tsukamoto et al. ..... 271/115
5,547,181 A * 8/1996 Underwood ..... 271/114

FOREIGN PATENT DOCUMENTS

| | | |
|---|---|---|
| JP | 56-141238 | 11/1981 |
| JP | 59-143827 | 8/1984 |
| JP | 62-167135 | 7/1987 |
| JP | 04-217520 | 8/1992 |
| JP | 2001-002264 | 1/2001 |

OTHER PUBLICATIONS

Korean Office Action dated Sep. 22, 2005, for KR 2004-0004979.

* cited by examiner

*Primary Examiner*—David H Bollinger
(74) *Attorney, Agent, or Firm*—Stanzione & Kim, LLP

(57) ABSTRACT

A two-way paper pickup system in which both a feed tray and a feed cassette can be used, and a printer adopting the same. The paper pickup system includes a feed tray on which paper or a feed cassette is placed, a first pickup assembly that moves the paper placed on the feed tray, a resistance plate that allows the moved paper to be separately transferred, and a second pickup assembly that is moved to a paper exit of the feed cassette so as to move paper included in the feed cassette when the feed cassette is placed on the feed tray. When the feed cassette is inserted into the printer, the first pickup assembly is moved on the feed cassette while being rotated.

17 Claims, 4 Drawing Sheets

TWO-WAY PAPER PICKUP SYSTEM

CROSS-REFERENCE TO RELATED APPLICATIONS

This application claims the priority of Korean Patent Application No. 2004-4979, filed on Jan. 27, 2004, in the Korean Intellectual Property Office, the disclosure of which is incorporated herein in its entirety by reference.

BACKGROUND OF THE INVENTION

1. Field of the Invention

The present general inventive concept relates to a two-way paper pickup system and a printer adopting the same, and more particularly, to a two-way paper pickup system in which both a feed tray and a paper cassette are available, and a printer adopting the same.

2. Description of the Related Art

In general, since most inkjet printers are manufactured as low-cost popular types, only a paper tray is adopted as a paper feed mechanism to minimize manufacture costs. FIGS. 1 and 2 illustrate a conventional inkjet printer and a conventional paper feed mechanism adopted by the conventional inkjet printer, respectively. Referring to FIG. 2, the conventional paper feed mechanism includes a feed tray 110 in which paper S is placed, a pickup roller 121 that moves the paper S placed on the feed tray 110, a pickup roller supporter 123 that delivers a driving force to the pickup roller 121 and pressurizes the pickup roller 121 onto the paper S, a resistance plate 140 that allows sheets of the paper S transferred by the pickup roller 121 to be supplied to a feed roller 130 one by one; and the feed roller 130 that supplies the paper S to a printing unit (not shown).

A process of supplying the paper S using the conventional paper feed mechanism will now be described with reference to FIGS. 1 and 2. First, the pickup roller supporter 123 and the pickup roller 121, fixed by an end of the pickup roller supporter 123, press the paper S on the feed tray 110 with their own weight. In this case, when the pickup roller supporter 123 delivers a driving force to the pickup roller 121, the delivered driving force rotates the pickup roller 121 to transfer the paper S toward the resistance plate 140. A plurality of projections 145 are formed on the resistance plate 140 to separately supply the paper S to the feed roller 130. When the paper S is stopped by the projections 145, only a sheet of the paper S directly contacting the pickup roller 121 is transferred to the feed roller 130. This method is referred to as a paper separation method using a resistance plate.

There is a growing need to develop popular-type printers adopting a paper feed mechanism, such as that shown in FIG. 2, that can use both nonstandard sized paper of various types and sizes and standard sized paper, e.g., A4, B5, or letter sized paper. Accordingly, in a tray-type feed mechanism adopted by a conventional inkjet printer, a paper pickup system that picks up and supplies sheets of paper S one by one has the pickup roller 121 installed at one side of the feed tray 110 as shown in FIG. 3B. That is, as shown in FIGS. 3A and 3B, which are a plan view of and a rear view of the paper pickup system, respectively, the pickup roller 121 is installed at one side of the feed tray 110 rather than at a center thereof, and a paper guide 115 is installed at the opposite side of the feed tray 110 so that the paper S does not sway from one side to another. In particular, the paper guide 115 is installed such that the paper guide 115 can slide on the feed tray 110 along the width direction. Therefore, the location of the paper guide 115 can be adjusted to a size of the paper S.

A reason for locating the pickup roller 121 to one side of the feed tray 110 is to allow paper having various sizes to be transferred toward the resistance plate 140. If the pickup roller 121 is installed at a center of the feed tray 110, it is impossible to move very small sized paper. In general, a minimum width of paper that can be fed in an inkjet printer is about 3 inch.

However, in a case where paper with various types or sizes are fed by only one feed tray, such as the feed tray 110, the performance of feeding paper is lower than when using a feed cassette dedicated to specific sized paper, e.g., A4 sized paper. Further, it is more difficult to feed special type paper, such as overhead transparency paper (OHP), label paper, and photo paper, only using one feed tray. In particular, the performance of feeding paper deteriorates when using low-quality paper to which a large amount of paper powder (paper dust) adheres. In this case, the pickup roller 121 becomes stained with the paper powder, thus considerably lowering the performance of feeding paper.

SUMMARY OF THE INVENTION

The present general inventive concept provides a low-cost tray-type paper pickup system in which both a feed tray for paper with various types or sizes and a feed cassette for low-quality paper or specific sized paper can be used, thereby improving feeding quality.

The present general inventive concept also provides a printer adopting such a two-way paper pickup system.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing a two-way paper pickup system of a printer that includes a feed tray on which paper or a feed cassette is placed, a first pickup assembly that moves the paper placed on the feed tray, and a resistance plate that allows the moved paper to be separately transferred, the system comprising a second pickup assembly that moves to a paper exit of the feed cassette so as to move paper included in the feed cassette when the feed cassette is placed on the feed tray.

When the feed cassette is inserted into the printer, the first pickup assembly is moved on the feed cassette while being rotated.

The foregoing and/or other aspects and advantages of the present general inventive concept may also be achieved by providing a printer that includes a two-way paper pickup system of a printer that includes a feed tray on which paper or a feed cassette is placed, a first pickup assembly that moves the paper placed on the feed tray, and a resistance plate that allows the moved paper to be separately transferred, the system comprising a second pickup assembly that moves to a paper exit of the feed cassette so as to move paper included in the feed cassette when the feed cassette is placed on the feed tray. When the feed cassette is inserted into the printer, the first pickup assembly is moved on the feed cassette while being rotated.

The paper placed on a feed tray is fed for a general print job, but when feeding of standard sized paper, such as letter sized paper, or special type paper is required, the paper placed on the feed tray is replaced with a feed cassette in which the standard sized paper or the special type paper is placed and the paper in the feed cassette is used. Therefore, it is possible to easily feed even paper that cannot be satisfactorily fed by a conventional tray-type pickup system without modifying the structure of the conventional tray-type pickup system, using the feed cassette.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
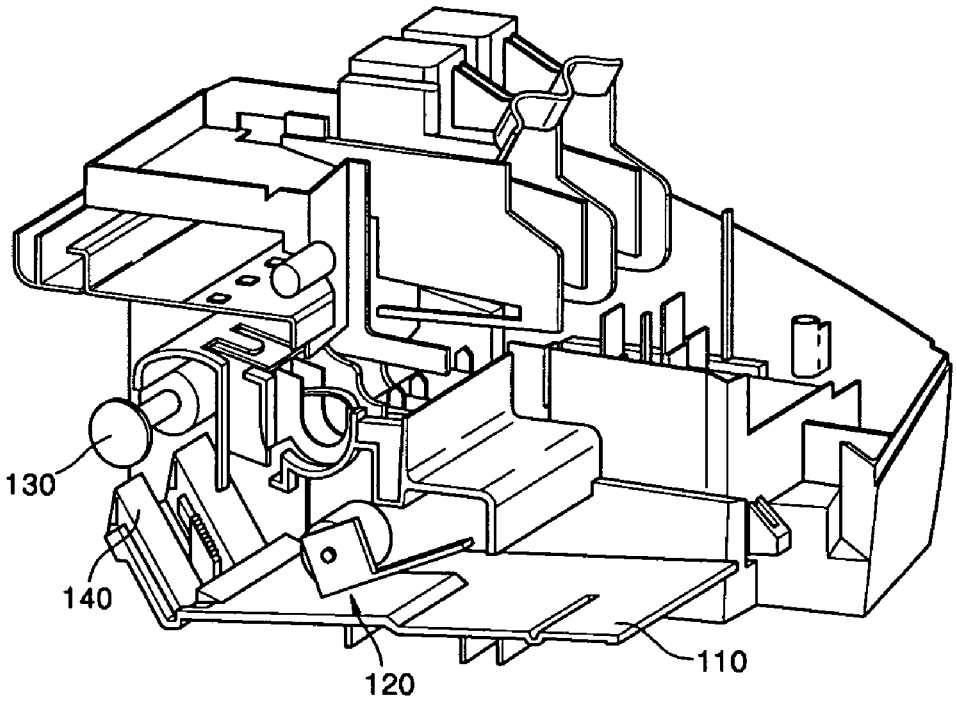
FIG. 1 (PRIOR ART)
FIG. 1 is a schematic view of a conventional inkjet printer.
Figure 2:
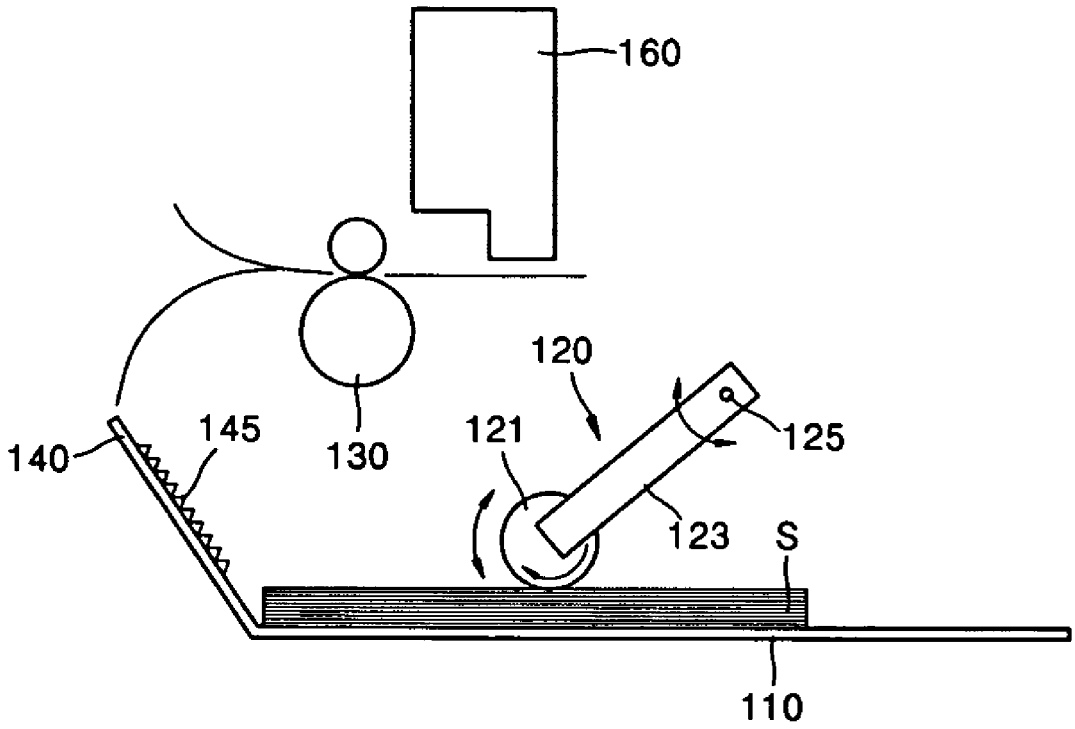
FIG. 2 (PRIOR ART)
FIG. 2 illustrates a structure of a paper pickup system adopted by a conventional inkjet printer.
Figure 3A:
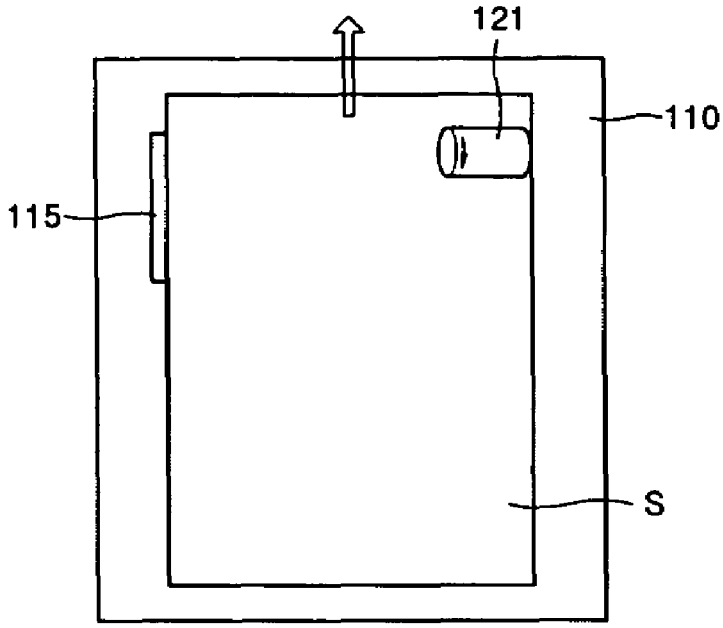
FIG. 3A (PRIOR ART)
FIGS. 3A and 3B are a schematic plan view and a rear view, respectively, of a paper pickup system adopted by a conventional inkjet printer.
Figure 3B:
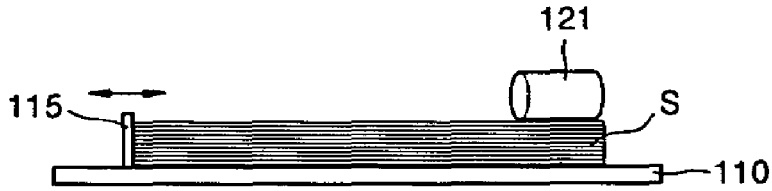
FIG. 3B (PRIOR ART)

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 4:
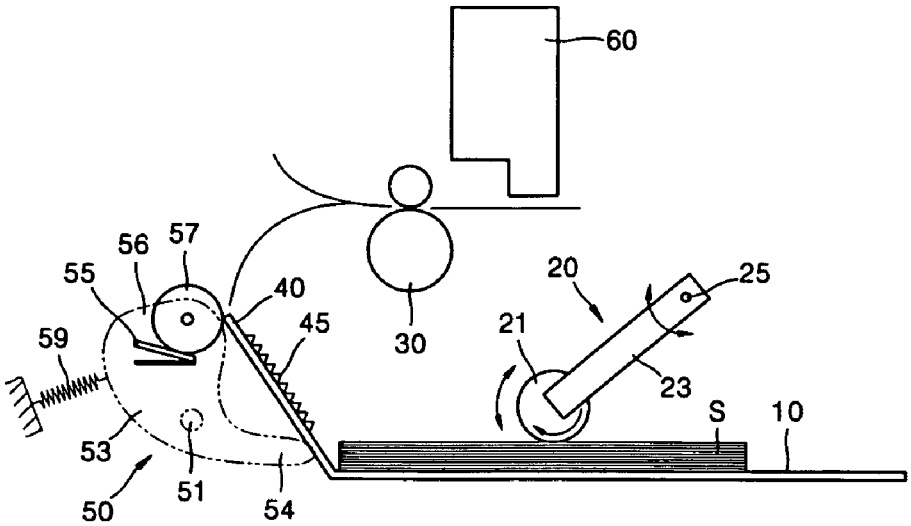
FIG. 4 illustrates a paper pickup system adopted by a printer when a feed cassette is not in use, according to an embodiment of the present general inventive concept.

FIG. 4 illustrates a two-way paper pickup system adopted by a printer when a feed cassette is not in use, according to an embodiment of the present general inventive concept. Similarly to a conventional paper pickup system, the two-way paper pickup system of FIG. 4 includes a feed tray 10 on which paper S is placed, a first pickup assembly 20 that moves the paper S placed on the feed tray 10, and a resistance plate 40 that allows sheets of the paper S delivered by the first pickup assembly 20 to be separately supplied one by one to a feed roller 30. Thus, detailed descriptions of these elements will be omitted.

Compared to the conventional paper pickup system, the paper pickup system of FIG. 4 further includes a second pickup assembly 50 installed in a printer (not shown) near the resistance plate 40. As shown in FIG. 4, the second pickup assembly 50 is manufactured such that a second pickup roller supporter 53 can be rotated with respect to a rotating axis 51. An upper part 56 of the second pickup roller supporter 53 is provided with both a second pickup roller 57 that moves the paper S from a feed cassette (not shown) and a friction pad 55 that separates sheets of the paper S delivered by the second pickup roller 57 one by one. Also, the second pickup roller supporter 53 is bent with respect to the rotating axis 51 at a predetermined angle. Accordingly, upper and lower parts 56 and 54, respectively, of the second pickup roller supporter 53, are inclined toward the feed tray 10 or the feed cassette depending on which one is presently being used.

As shown in FIG. 4, when the paper S, rather than the feed cassette, is placed on the feed tray 10, the upper part 56 of the second pickup assembly 50 is drawn back by a spring 59 so that the second pickup roller 57 does not interfere with feeding of the paper S. In this case, the second pickup roller 57 deviates from a path along which the paper S is fed. FIG. 4 illustratively shows that the spring 59 is installed between the upper portion 56 of the second pickup assembly 50 and a frame (not shown) inside the printer, but the spring 59 may be replaced by any elastic device. Alternatively, a hinge spring may be used by coupling it to the rotating axis 51, rather than the spring 59, the hinge spring being connected between the upper portion 56 of the second pickup assembly 50 and the frame inside the printer.

A method of feeding the paper S from the feed tray 10 is similar to the conventional method described supra. More specifically, when a first pickup roller 21 of the first pickup assembly 20 is rotated while being in contact with the paper S, the paper S is transferred toward the resistance plate 40. The first pickup roller 21 is installed to be rotatable while being fixed to an end of a first pickup roller supporter 23. The other end of the first pickup roller supporter 23 is also installed to be rotatable while being fixed to the frame inside the printer. Therefore, the first pickup roller 21 contacts the paper S due to the weight of the first pickup roller supporter 23. Also, the first pickup roller supporter 23 delivers a driving force to the first pickup roller 21. A plurality of projections 45 are formed on the resistance plate 40. Feeding of the paper S is controlled by the projections 45 such that only one sheet of the paper S, i.e., the top most sheet, which contacts the first pickup roller 21 is transferred to the ink cartridge 60 via the feed roller 30.

Figure 5:
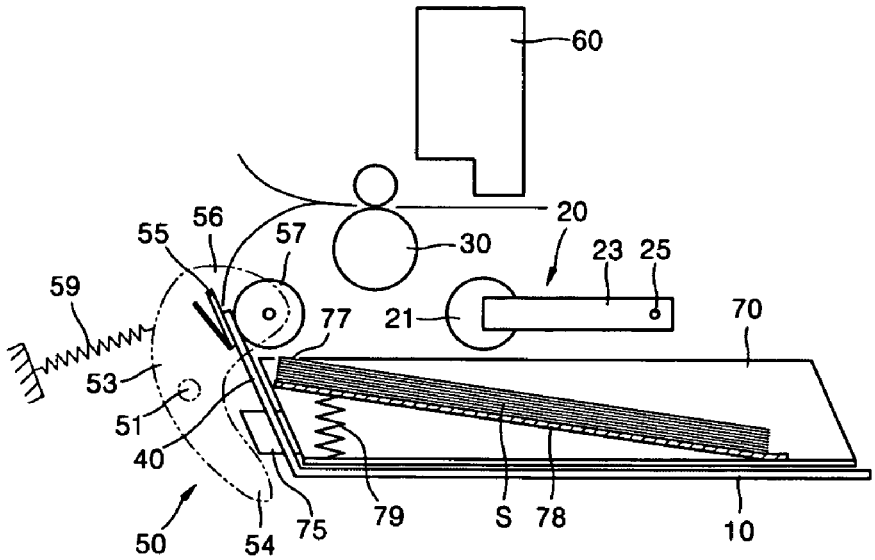
FIG. 5 illustrates a paper pickup system adopted by a printer while a feed cassette is in use, according to an embodiment of the present general inventive concept.

FIG. 5 illustrates a two-way paper pickup system adopted by a printer (not shown) while a feed cassette is in use, according to an embodiment of the present general inventive concept. When a user desires to use a cassette-type paper pickup system that enables feeding of special paper or standard sized paper, a feed cassette 70 in which paper S is placed is positioned on a feed tray 10. The feed cassette 70 slides on the feed tray 10 and then is inserted into the printer. As shown in FIG. 5, when the feed cassette 70, rather than paper, is placed on the feed tray 10, a first pickup assembly 20 is rotated while being pushed upward by the feed cassette 70 and moved along an upper side of the feed cassette 70. In this case, the first pick assembly 20 does not operate to transfer paper.

A projection 75 is formed at a portion of a front lower part of the feed cassette 70. While the feed cassette 70 slides on the feed tray 10, a lower part 54 of a second pickup roller supporter 53 is pushed back and rotated by the projection 75. One or more projections 75 may be used. An aperture (not shown) must be formed in a portion of a resistance plate 40 that faces the projection 75 so that the projection 75 can pass through the resistance plate 40 and push back the lower part 54 of the second pickup roller supporter 53. When the second pickup roller supporter 53 is rotated due to the projection 75, a second pickup roller 57, which is installed to be rotatable while being fixed with an upper part 56 of the second pickup roller supporter 53, is moved to a paper exit 77 of the feed cassette 70. At the paper exit, the second pickup roller 57 is coupled to a driving unit (not shown) where it is provided with a driving force.

A method of feeding paper using the feed cassette 70 according to an embodiment of the present general inventive concept will now be described. As is well known in the prior art, an aperture 77 is formed in a front upper part of the feed cassette 70 widthwise. The aperture 77 acts as a paper exit through which paper is fed to the printer. Also, in the feed cassette 70, a tray 78 on which paper S is placed and a pressure device 79 that pushes the paper S placed on the tray 78 upward to the paper exit 77 are installed. Thus, the second pickup roller 57 can contact the paper S at the paper exit 77 of the feed cassette 70. When the printer operates, the second pickup roller 57 is rotated to drag the paper upward and out of the feed cassette 70. The dragged paper is inserted between the second pickup roller 57 and a friction pad 55 formed of rubber. Since a surface friction coefficient $\mu_R$ of the second pickup roller 57 is greater than a surface friction coefficient $\mu_P$ of the friction pad 55, only the top most sheet of the paper is selected and transferred to the feed roller 30. Then, printing is performed on the transferred paper using the ink cartridge 60. As described above, it is possible to more effectively and separately feed paper using a friction pad than when using a resistance plate with projections.

If a user desires to feed paper using the feed tray 10, the feed cassette 70 can be removed from the feed tray 10 and then paper is put on the feed tray 10 in place of the feed cassette 70. Then, the second pickup roller 57 returns to its original position due to a restoring force of a spring 59, and the first pickup roller 21 becomes in contact with the paper again due to its own weight as shown in FIG. 4.

As described above, a paper pickup system according to the various embodiments of the present general inventive concept allow a user to use a feed tray when performing a print job regardless of the size and type of paper, and to use a feed cassette dedicated to specific sized paper alternatively. Accordingly, it is possible to improve the performance of feeding paper since both the feed tray and the feed cassette can be used, without remarkably increasing manufacture costs, as compared to a conventional feed mechanism that uses only a feed tray based on a paper separation method using a resistance plate.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A two-way paper pickup system of a printer comprising:

a feed tray on which paper or a feed cassette to supply paper is placed;

a first pickup assembly that moves the paper placed on the feed tray;

a resistance plate that allows the moved paper to be separately transferred; and a second pickup assembly that moves to a paper exit position of the feed cassette when contacted by a contacting portion of the feed cassette so as to transfer paper out of the feed cassette when the feed cassette is placed on the feed tray.

2. The system of claim 1, wherein the feed cassette can slide on the feed tray and then is inserted into the printer.

3. The system of claim 1, wherein when the feed cassette is inserted into the printer, the first pickup assembly is moved along an upper side of the feed cassette while being rotated.

4. The system of claim 1, wherein the second pickup assembly comprises:

a second pickup roller supporter;

a second pickup roller that is rotated to move the paper in the feed cassette; and a friction pad that allows the moved paper to be separately moved with respect to other papers, wherein the second pickup roller and the friction pad are fixed to the second pickup roller supporter.

5. The system of claim 4, wherein the second pickup roller supporter is rotatable with respect to a rotating axis, and is rotated by the contacting portion of the feed cassette when the feed cassette is positioned on the feed tray so that the second pickup roller is moved to a paper exit position of the feed cassette and is moved back to its original position when the feed cassette is removed from the feed tray.

6. The system of claim 5, wherein the second pickup roller supporter is bent with respect to the rotating axis at a predetermined angle such that both ends thereof are inclined toward the feed cassette.

7. The system of claim 6, wherein the second pickup assembly further comprises:

an elastic device that allows the second pickup roller supporter to be rotated so that the second pickup roller can return to its original position when the feed cassette is removed from the feed tray.

8. The system of claim 7, wherein the elastic device is a spring connected to the second pickup roller supporter and an inside of the printer.

9. The system of claim 5, further comprising a projection formed at the feed cassette so that the second pickup roller supporter is pushed back and rotated by the projection when the feed cassette is placed on the feed tray.

10. The two-way paper pickup system of a printer of claim 1, wherein the contacting portion of the feed cassette comprises a plurality of projections to push the second pickup assembly to the paper exit of the feed cassette when the feed cassette is slid into the feed tray.

11. A paper feeding system used with an image forming apparatus having a feed tray and resistance plate combination, comprising:

a first pickup assembly including a first pickup roller rotatably connected to a first pickup roller supporter to contact paper within the feed tray and feed the paper to the image forming apparatus; and a second pickup assembly including a second pickup roller rotatably connected to a second pickup roller supporter, the second pickup roller pivots into contact with the resistance plate when contacted by a second contacting portion of the feed cassette when the feed cassette is positioned on the feed tray to feed paper from within a feed cassette to the image forming apparatus.

12. The paper feed system of claim 11, further comprising:

a first pickup roller supporter axis on which the first pickup roller supporter pivots to rotate the first pickup roller into contact with the paper; and a second pickup roller supporter axis on which the second pickup roller supporter rotates to pivot the second pickup roller into contact with the resistance plate.

13. The paper feed system of claim 12, wherein a first contacting portion of the feed cassette contacts the first pickup roller supporter to pivot the first pickup roller away from the paper in the feed tray when the feed cassette is placed on the feed tray while the second contacting portion of the feed cassette simultaneously contacts the second pickup roller supporter to rotate the second pickup roller into contact with the paper within the feed cassette.

14. The paper feed system of claim 12, wherein the second contacting portion of the feed cassette comprises a projection that extends through an aperture of the resistance plate to press and rotate the second pickup roller supporter when placed on the feed tray.

15. A two way paper pickup method for an image forming apparatus having a paper feed tray, the method comprising:

feeding paper placed on the feed tray into the image forming apparatus using a first pickup assembly installed above the feed tray; and feeding paper of a feed cassette using a second pickup assembly when the feed cassette is placed on the feed tray, wherein placing the feed cassette on the feed tray rotates the second pickup assembly to a paper exit of the feed cassette.

16. The method of claim 15, wherein the second pickup assembly comprises:

a second pickup roller to feed the paper in the feed cassette; and a second pickup roller supporter to support the second pickup roller at an upper portion thereof, wherein a protrusion of the feed cassette rotates the second pickup roller supporter such that the second pickup roller is disposed at the paper exit of the feed cassette when the feed cassette is placed on the feed tray.

17. The method of claim 16, wherein only the first pickup assembly feeds paper to the image forming apparatus when the feed cassette is not placed on the feed tray, and only the second pickup assembly feeds paper to the image forming apparatus when the feed cassette is placed on the feed tray.

* * * * *